United States Patent [19]

Metzler

[11] 4,341,183

[45] Jul. 27, 1982

[54] VETERINARY APPARATUS

[76] Inventor: Louis A. Metzler, 365 Chestnut St., Stirling, N.J. 07980

[21] Appl. No.: 144,878

[22] Filed: Apr. 29, 1980

Related U.S. Application Data

[63] Continuation-in-part of Ser. No. 10,136, Feb. 7, 1979, abandoned, which is a continuation-in-part of Ser. No. 840,122, Oct. 7, 1977, abandoned.

[51] Int. Cl.[3] ..... A61D 11/00

[52] U.S. Cl. ..... 119/158; 128/365; 128/66; 4/558; 4/574

[58] Field of Search ..... 119/29, 158, 159; 128/66, 365, 366, 370; 4/542, 556, 558, 567, 568, 569, 574

[56] References Cited

U.S. PATENT DOCUMENTS

| | | | |
|---|---|---|---|
| 2,529,255 | 11/1950 | Jobe | 4/542 |
| 3,062,188 | 11/1962 | O'Day | 119/159 |
| 3,288,134 | 11/1966 | Reich | 128/66 |
| 3,476,106 | 11/1969 | Ritz et al. | 128/66 |
| 3,477,424 | 11/1969 | Tracy | 128/66 |
| 3,863,275 | 2/1975 | Brendgord et al. | 4/556 |
| 4,225,984 | 10/1980 | Lindsey | 128/66 X |

FOREIGN PATENT DOCUMENTS

| | | | |
|---|---|---|---|
| 2006042 | 8/1971 | Fed. Rep. of Germany | 128/66 |
| 2229415 | 1/1974 | Fed. Rep. of Germany | 128/66 |
| 2710948 | 9/1978 | Fed. Rep. of Germany | 128/66 |

*Primary Examiner*—Paul J. Hirsch
*Assistant Examiner*—Robert P. Swiatek
*Attorney, Agent, or Firm*—John P. Sinnott

[57] ABSTRACT

A typical embodiment of the invention provides a means for applying a therapeutic liquid spray to the leg of a horse. A plastic bucket, for example, contains a top header and a bottom header joined in fluid communication by means of pivotally mounted spray tubes. The spray tubes can be turned to direct the spray to the portion of the animal's leg that is being treated. A circulating pump draws the spray fluid from the bottom of the bucket and pumps it through a valve to the headers. The valve, moreover, can not completely stop the flow, thereby protecting the pump from damage if the valve is inadvertently closed while the pump is running.

8 Claims, 5 Drawing Figures

VETERINARY APPARATUS

This application is a continuation-in-part of abandoned application Ser. No. 10,136 filed Feb. 7, 1979 which is, in turn, a continuation-in-part of abandoned application Ser. No. 840,122, filed Oct. 7, 1977.

BACKGROUND OF THE INVENTION

1. Field of the Invention

This invention relates to therapeutic devices for veterinary use and, more specifically to therapeutic spray apparatus for treating the legs of horses, and the like.

2. Description of the Prior Art

Because injuries to the leg of a horse can be quite serious, it is very important to devise means for treating these injuries when they occur. Perhaps, sprains, bruises, and swelling in the ankle or knee are the most frequently treated of these injuries, although "splints" or "bucked shins", a condition that affects the tendon between the ankle and the knee, also occurs and requires treatment.

Often the treatment for these conditions is quite primitive, e.g., requiring an attendant to stand by the hour with a garden hose, spraying the afflicted part of the horse's leg, or to laboriously hand rub a topical application to the injured member. More modern treatment might involve bandaging the injury or placing two of the horse's legs in a bucket of water, or water and epsom salts. A device in the bucket blows air bubbles through the liquid to circulate the liquid and to produce a mild massaging effect.

Clearly, all of these techniques leave a great deal to be desired. Spraying the leg with a garden hose or massaging or bandaging consumes a great deal of time and labor, not to mention the physical risk to the attendant in touching the injured leg of a horse. Air bubble agitation also is unsatisfactory because the massaging effect is very mild, most of the bubbles flowing through the liquid and bypassing the injured area. Further in this regard, the bucket containing the water must be quite large in order to accommodate both of the horse's fore legs or hind legs. In this respect, it is a characteristic of horses that they will not place only one leg in a large bucket. Both the injured leg and its companion fore- or hind leg must be placed in the bucket.

In these circumstances, large quantities of water and, if required, epsom salts must be used to fill the bucket. The full bucket becomes unwieldy and requires a wasteful excess of epsom salts.

Accordingly, there is a clear need to provide some better and more efficient means to treat an injured horse leg.

SUMMARY OF THE INVENTION

These and other difficulties that have characterized prior techniques for treating the injured leg of a horse are overcome through the practice of the invention. More particularly, a bucket is provided that contains a top header and a bottom header. These headers are joined in fluid communication with a generally longitudinal array of spray tubes. These spray tubes have a number of particularly unique features. They can, for example, pivot in order to direct the spray at the injured member. This pivoting feature is quite significant because, it will be recalled, two of the horse's legs are in the bucket at the same time. By pivoting the spray tubes to orient most of the spray away from the sound leg and toward the injured member, the spray can enjoy an efficiency of as much as 90%.

A further novel feature of the spray tubes that characterize the invention is the spacing of the spray apertures along the length of the tubes. In this regard, it has been noted that most injuries to horse's legs occur in the region of the ankle or the knee, the "splints" or "bucked shins" that require treatment to the portion of the leg in between the ankle and the knee that corresponds to the cannon bone occurring less frequently. To accommodate this situation, the spray apertures are clustered in the spray tube regions that are adjacent to the average horse ankle and knee, the apertures between these clusters being spaced somewhat further apart.

A low level of spraying fluid is maintained in the apparatus, the level of the fluid being below the lowest of the spray apertures in order to make the spray fully effective. A screen unit in the bottom portion of the bucket, moreover, provides a filtered intake for the circulating pump to enable the accumulated fluid on the bottom of the bucket to circulate back through a discharge conduit to the top and bottom headers by way of a special valve.

The valve provides not only a means for metering the flow into the headers in order to regulate the intensity of the spray that is applied to the injured leg, but also provides a means for protecting the pump from damage. This further feature of the invention protects the pump by insuring that there is always some positive fluid flow through the valve. Ordinarily, if a stable hand should inadvertently close the valve while the pump is running, cavitation will very quickly destroy the pump impeller. By providing a positive leakage through the valve, even with the valve in the full "closed" position, however, the impeller will be protected from cavitation damage.

An additional embodiment of the invention provides a spray tube structure in which three tubes are joined to pivot as a single unit. This particular structure reduces the time required to direct the spray at the injured portion of the horse's leg.

Attendants have found that it is difficult in some instances to induce a horse to raise an injured leg over the top of the bucket and to lower that leg down to the bucket bottom. Thus, in a further embodiment of the invention a portion of the bucket side wall is removed to establish only a short sill which extends upward from the bucket bottom. It is relatively easy to help a horse step over this low sill and into the bucket. To restore the water-tight integrity to the bucket, a sheet of durable and flexible vinyl material is placed across the side opening in the bucket. Preferably, Velcro strip secured to the edges of the vinyl sheet and to the matching edges of the bucket side opening serve to hold the vinyl sheet in place and prevent much of the spray from escaping from the bucket.

To permit the horse's leg to step through the bucket side opening, only a bottom header for the spray apparatus is required, thereby eliminating the top header as a barrier to the movement of the leg.

Thus, the invention provides not only a more efficient means for therapeutically treating an animal's injured leg, but also provides a technique for protecting the apparatus from serious damage through misuse. The equipment that characterizes the invention relieves attendants of the time consuming task of spraying an injured leg with a garden hose or taking the personal physical risk that is involved in laboriously massaging or bandaging the animal's injured limb. The positive action of the spray that characterizes the invention also is a significant improvement over the air bubble agitation device in the prior art because this spray can be specifically directed at the injury and does not require a large and awkward-to-handle bucket full of water and epsom salts.

The various features of novelty which characterize the invention are pointed out with particularity in the claims annexed to and forming a part of this specification. For a better understanding of the invention, its operating advantages and specific objects attained by its use, reference should be had to the accompanying drawing and descriptive matter in which there is illustrated and described a preferred embodiment of the invention.

DETAILED DESCRIPTION OF THE PREFERRED EMBODIMENTS

Figure 1:
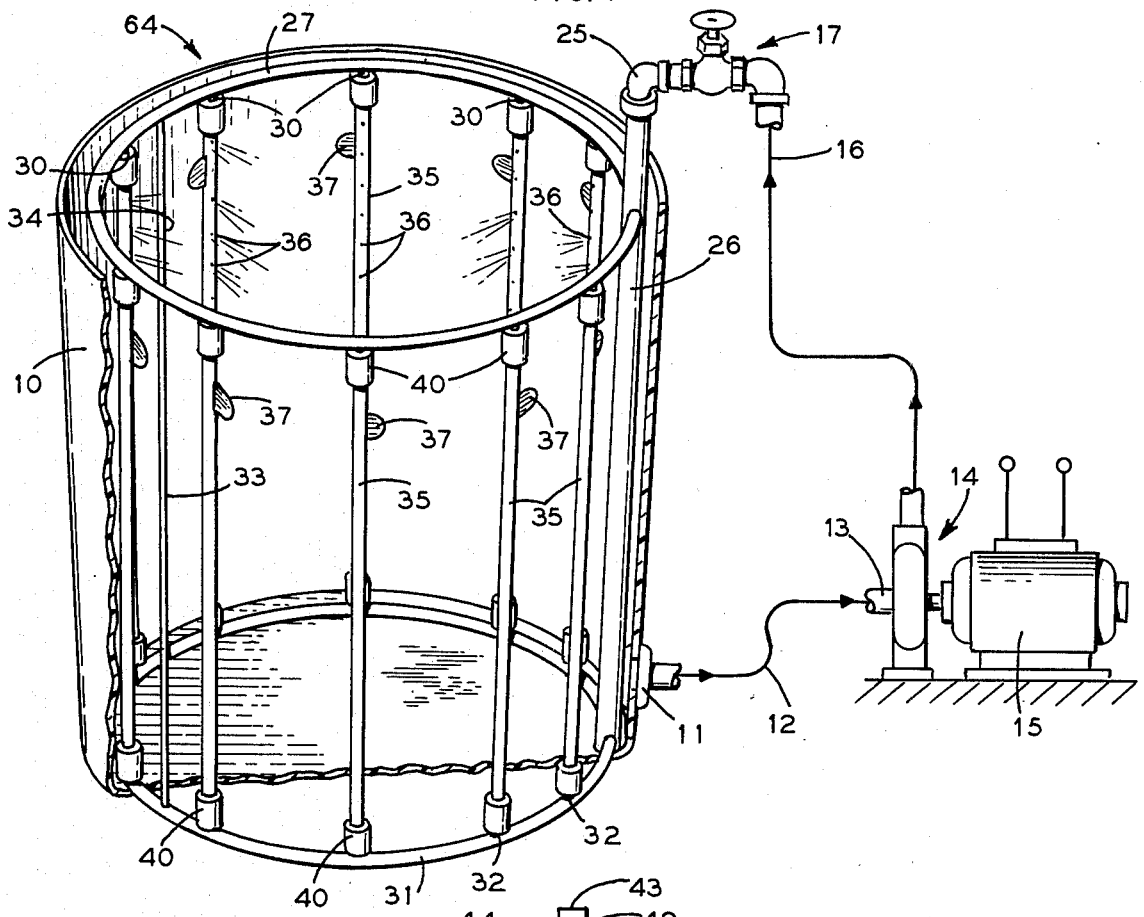
FIG. 1 is a perspective view, in section, of a typical embodiment of the invention.

For a more complete appreciation of the invention, attention is invited to FIG. 1 which shows bucket 10 of plastic or other suitable material. Illustratively, a plastic bucket about 25" deep that has a bottom diameter of somewhat more than 20½" will be suitable for the practice of the invention. In the vertical side of the bucket 10 close to the bucket bottom a screen unit 11 establishes fluid communication between the interior of the bucket and an intake conduit 12. The screen unit 11 preferably contains a mesh screen of stainless steel, or other acceptable material, to strain solid matter out of fluid that is being drawn from the bucket 10 to the intake conduit 12. In this regard, hay, oats and hair are typical of the material that must be removed from the fluid.

With respect to the intake conduit 12, it has been found that 1" inside diameter clear plastic hose is suitable for the purpose of the invention. Thus, as shown in FIG. 1, the intake conduit 12 is coupled in fluid communication to an inlet coupling 13 on a centrifugal pump 14. Typically, the pump 14 is driven by means of a conventional electric motor 15. It has been found, for example, that a ¾ horsepower 115 volt electric motor driving a pump with a capacity of 82 to 84 gallons per minute is adequate for the practice of the invention.

The centrifugal pump 14 discharges fluid through an outlet conduit 16. A ¾" inside diameter clear plastic hose is preferred for the outlet conduit 16. The outlet conduit 16 is coupled to a special valve 17.

Figure 3:
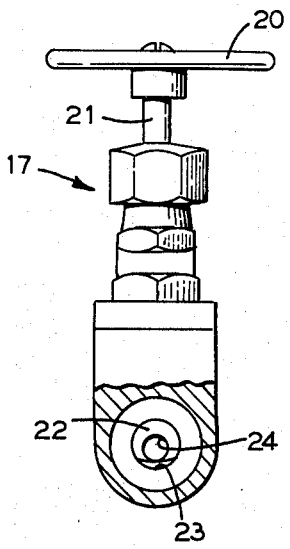
FIG. 3 is a front elevation, in partial section, of a valve that is suitable for use with the embodiment of the invention that is shown in FIG. 1.

As illustrated in FIG. 3, the special valve 17 has a conventional wheel or handle 20 that is connected to a valve stem 21. Appropriate manipulation of the handle 20 drives a gate 22 into a valve seat 23 or withdraws the gate 22 from the valve seat. In accordance with a feature of the invention, a ¼" diameter hole 24 is drilled into the gate 22 in order to prevent the valve from completely stopping fluid flow. Thus, depending on the position of the gate 22 in the valve seat 23, the gate will partially block flow through the valve or permit some greater degree of controlled or throttled flow through the valve 17.

Turning once more to FIG. 1, the other coupling on the valve 17 is connected to an ell 25 that is joined to a fluid distribution tube 26. As shown, the distribution tube 26 is mounted within the bucket 10 in a generally vertical manner, close to the inside wall of the bucket.

A typical distribution tube 26 would be about 26¼" long and have a 1" inside diameter, terminating in a water-tight plug at the bottom end.

Stainless steel or copper tubing are the preferred materials for the structural components of the invention that are positioned within the bucket 10. In those instances in which other materials are more suitable, special mention of these materials will be made.

The distribution tube 26 is joined to and establishes fluid communication with a top ring or top fluid header 27.

The top fluid header 27 may be formed from ¾" inside diameter tube that is bent into a ring. An array of ten downwardly directed nipples 30 are joined to the top header 27 at essentially equally spaced intervals to establish fluid communication with the interior of the header 27. Thus, as illustrated in FIG. 1, as measured from the distribution tube 26 in a clockwise manner as viewed in the drawing from a direction looking downward toward the top fluid header 27, the nipple adjacent to the tube 26 is separated from that tube by a 35° angle. Each successive nipple, including spacer tubes 33, 34, in clockwise order, is separated from the distribution tube by 60°, 85°, 110°, 135°, 165°, 200°, 230°, 260°, 275°, 305° and 325°.

A bottom ring or bottom header 31, also is preferably formed of ¾" inside diameter tubing. The bottom header 31 is bent to form a ring that could have an outside diameter of about 20½". In a manner that is similar to that which was described in connection with the top fluid header 27, the bottom header also has an array of nipples 32 that are joined to the bottom header and establish fluid communication with the inside of the bottom header. The nipples 32, however, are oriented in an upward direction and have a relative angular distribution that matches and corresponds to the angular distribution of the nipples 30 on the top fluid header 27.

Proper separation between the headers 27 and 31 is maintained by the fluid distribution tube 26 and two spacer tubes 33, 34 that each are spaced about 120° from each other. Not only does this arrangement serve to keep proper separation between the headers 27, 31, but it also enhances the structural integrity of the apparatus within the bucket 10.

In accordance with another feature of the invention, the top header nipples 30 are joined in fluid communication with the respective bottom header nipples 32 by means of individual spray tubes 35. As shown in FIG. 1, each of the ten spray tubes 35 has a group of longitudinally aligned spray apertures 36 which, as described subsequently in more complete detail, enable fluid from the headers 27 and 31 to spray in a preferred direction within the bucket 10. The spray apertures 36 of each of the spray tubes 35 are clustered, top and bottom, near the adjacent respective nipples 30 and 32. Typically, five spray apertures are clustered on the spray tube in an area that would approximate the level of the average horse ankle. Four spray apertures are grouped in an area on the spray tube that is about at the level of the average horse knee, and three spray apertures are located in the general area of the cannon bone. Some further spray apertures are distributed, as mentioned, along the middle portion of the individual spray tubes 35, but the spray apertures in this middle portion of the tubes are not as abundant as the concentrated clusters in the vicinity of the upper and lower nipples 30 and 32, respectively. Overall, it has been found that twelve spray apertures in a 22" length of tubing, distributed in the manner described above, is quite adequate for the purposes of the invention.

Adjustment tabs 37 also are secured to each of the spray tubes 35 near the top fluid header 27 to enable the spray from each of the spray tubes to be directed to achieve an optimum therapeutic effectiveness as described subsequently in more complete detail.

Each of the spray tubes 35 preferably is formed from ⅜" tubing in lengths that are suitably to span the vertical downward and inward distance between the associated nipple 30 on the top fluid header 27, and the corresponding nipple 32 on the bottom header 31, which has a somewhat smaller outside diameter. Short, tight fitting plastic sleeves 40 span the respective joints between the upper and lower ends of each of the spray tubes 35 and their associated upper and lower nipples 30, 32. Illustratively, ½" inside diameter pieces of plastic tubing have been found suitable for the purpose of establishing a reasonably water tight seal that nevertheless permits the individual spray tubes 35 to be pivoted relative to the center of the bucket 10 in order to orient the spray from the tubes 35 in a preferred direction within the bucket 10.

Figure 2:
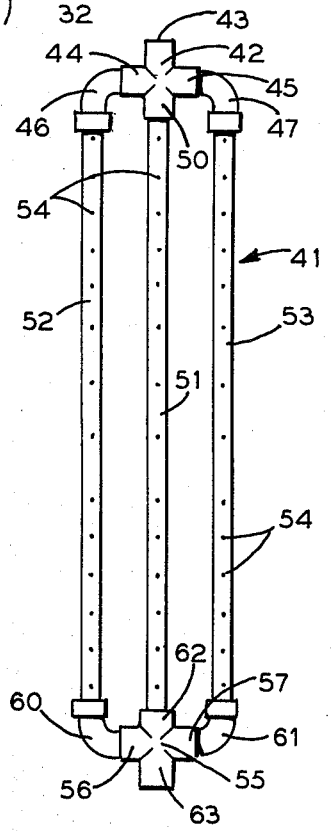
FIG. 2 is a front elevation of an alternate embodiment of a spray tube assembly for use in connection with the apparatus that is shown in FIG. 1.

Attention now is invited to FIG. 2 which shows a somewhat different spray tube array 41. Thus, a four-way fitting 42 has an inlet 43 for connection to an appropriate upper header nipple 30 (FIG. 1). Two transverse outlets 44, 45 (FIG. 2) on the fitting 42 communicate with respective ells 46, 47 while the third outlet 50 communicates directly with a spray tube 51. The ells 46, 47 also are coupled to respective spray tubes 52, 53. Note particularly in connection with these spray tubes 51, 52, 53 that the clustering of spray apertures 54 near the ends of the spray tubes, a characteristic feature of this invention, is quite clearly shown.

The bottom of the spray tube array 41 terminates in another four way fitting 55, in which couplings 56, 57 are joined through respective ells 60, 61, to the individual spray tubes 52, 53. The central spray tube 51, moreover, is joined directly to coupling 62. The four way fitting 55 also has an inlet coupling 63 for connection to a suitable nipple on the bottom header 31 (FIG. 1). The spray tube array 41 is connected to the top header 27 and to the bottom header 31 through associated nipples 30, 32 and sleeves 40 in the manner described in connection with FIG. 1. Note that the spray tube array 41 that is shown in FIG. 2 does not require the adjustment tabs 37 that are shown in FIG. 1 for spray orientation purposes. The ell and four way fitting structure on the spray tube assembly 41 (FIG. 2) provides a sufficient purchase for pivotal orientation relative to the inlet couplings 43 and 63. The three spray tubes in the bank, or array, further permit a more rapid orientation of the spray relative to the animal's injury.

In operation, the spray tubes 35 (FIG. 1) are coupled to the respective top header nipples 30 and bottom header nipples 32 by slipping the sleeves 40 over the connection between the ends of each of the spray tubes 35 and the adjacent nipples. A spray structure 64 so assembled is placed inside the bucket 10 so that the headers 27, 31 are generally concentric with the top and bottom of the bucket. A pad that is from ½" to 1" thick (not shown) of foam rubber, or other suitable material, is placed on the bottom of the bucket to prevent the shod hoofs of the horse from piercing, or damaging the bottom of the bucket 10.

Both hind or forelegs of a horse, depending on the location of the injury, are placed in the bucket 10. About 5 to 7 gallons of water are poured into the bucket 10, some medication—of which epsom salts is typical—can be added to this water. The valve 17 is closed so that only a flow passage through the hole 24 (FIG. 3) in the gate 22 remains open and the motor 15 (FIG. 1) is energized to drive the centrifugal pump 14. With the foregoing volume of fluid in the apparatus, a condition of fluid level equilibrium will be reached quickly in which the free standing water level in the bucket 10 is just above the screen unit 11. This fluid level will expose the bottom-most spray aperture 36 in order to provide the most efficient possible spray utilization. An attendant grasps in turn each of the tabs 37 to manually pivot the spray tubes 35 in order to orient the spray most effectively toward the injured portion of the animal's limb. In this respect, it should be recalled that most leg injuries on horses' legs tend to be in the vicinity of the ankle or the knee. Thus, clustering the spray apertures on the spray tubes 35 at locations that generally are opposite to these portions of the average horse leg further enhances the efficiency of treatment with the apparatus that characterizes the invention.

After directionally orienting the spray from the tubes 35, the gate valve 17 is gradually opened until the desired spray intensity is reached. Should the attendant leave the centrifugal pump 14 running while the valve 17 is in its fully closed position, the pump nevertheless will not destroy itself because some positive flow through the pump will be maintained by means of the hole 24 (FIG. 3) in the valve gate 22.

After the horse has been treated, the motor 15 (FIG. 1) is deactivated and the animal's legs are taken out of the bucket 10. The few gallons of fluid required in the use of this apparatus are easily disposed of and debris is removed from the screen in the screen unit 11.

Operation of the apparatus that characterizes the invention with the spray tube array 41 that is shown in FIG. 2 is essentially the same as that described with respect to FIG. 1.

If it is further desired, appropriate provisions also can be made for the pump 14 (FIG. 1) to generate a pulsating spray of fluid.

Figure 5:
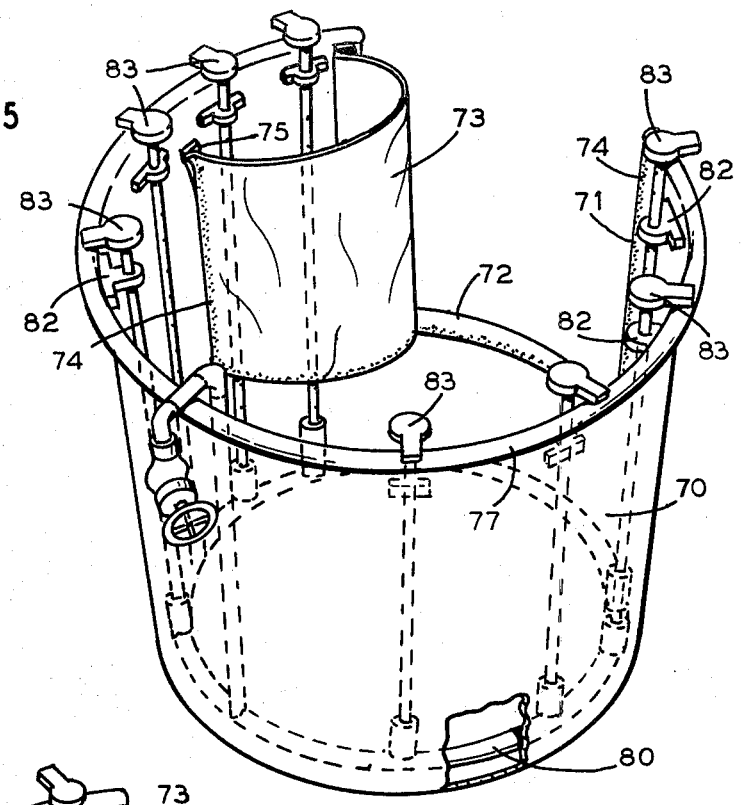
FIG. 5 is a perspective view of the embodiment of the invention that is shown in FIG. 4, with the curtain open.
Figure 4:
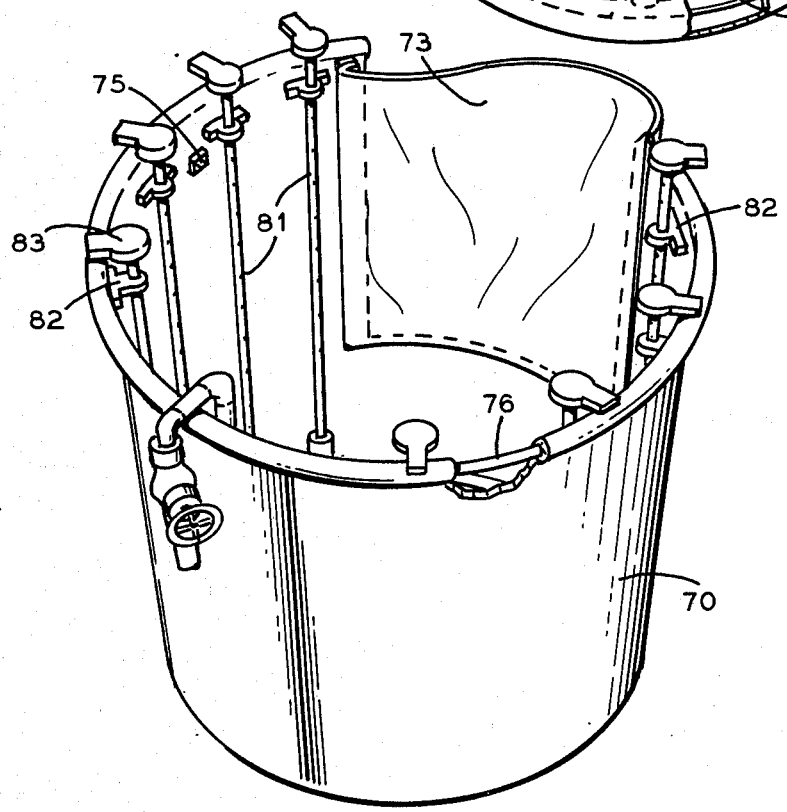
FIG. 4 is a perspective view of another embodiment of the invention.

Attention now is invited to FIGS. 4 and 5 which show a further embodiment of the invention illustrating a somewhat different bucket 70 from which a portion 71 of the bucket's side has been removed. Thus, an aperture is formed in the side of the bucket 70 that provides a sill 72 which has a top edge that is about ten inches above the bucket bottom.

As illustrated, a sheet 73 of flexible and sturdy vinyl plastic, for example, closes the gap that is formed by the open portion of the side of the bucket 70. The sheet 73 is temporarily secured to the opposing and matching edges that define the open side of the bucket by means of Velcro or other suitable fasteners 74.

Thus, as shown, the opening in the side of the bucket 70 forms an arc that subtends an angle of about 45°, if measured, at the vertical centerline of the bucket. In a typical embodiment of the invention, the opening can be as much as sixteen inches deep, if measured downwardly toward the bottom of the bucket from the bucket's top. The chord at the top of the sill can be as much as fifteen inches long and the chord at the top of the bucket could be seventeen inches long.

Note also in FIG. 4 that small strip 75 of Velcro or other fastener is secured to the top inner surface of the bucket to secure the free end of the sheet 73 when that sheet is withdrawn from the side opening 71 of the bucket 70.

To further strengthen the bucket 70, which has been somewhat weakened because of the removal of a portion of its surface, a stiffener 76 is inserted under a roll 77 that is formed at the open top edge of the bucket 70. Quite frequently, an arcuate tube of ¾ inch stainless steel tubing is suitable for this purpose.

Within the bucket 70, a spray apparatus is provided in which a bottom header 80 supports an upwardly extending array of spray tubes 81. In general, the construction of the bottom header 80, the header nipples and these tubes (which are adjacent to, but spaced from the inner wall of the bucket 70) is similar to that described in connection with the embodiment of the invention shown in FIGS. 1 through 3, inclusive. There is, however, no upper header, and the ends of the spray tubes that are near the top of the bucket 70 are received in journal bearings 82. The bearings 82 are riveted, or otherwise suitably secured to the inner wall of the bucket 70 and have vertical apertures which enable the individual spray tubes in the array 81 to be turned in order to achieve a desired spray distribution.

Further in this respect, tube closures 83, which seal the top ends of each of the respective tubes in the array 81, each are provided with small transverse tabs to simplify manipulation of the tubes for spray orientation.

Turning now to FIG. 5, the curtain or sheet 73 is moved to one side in order to expose the removed side portion 71 of the bucket 70. The low sill 72 also is displayed more clearly in this view.

In operation, with the sheet 73 moved away from the open side portion 71, the fasteners 75 and 74 on the sheet and on the bucket 70 are secured together to keep the sheet 73 to one side. The horse's legs (not shown) now can be lifted with comparative ease over the low sill 72 and placed in the bucket 70.

The sheet 73 now is sealed across the open side portion 71 of the bucket 70 in order to provide a temporary and essentially spray-proof closure for the bucket. A suitable charge of liquid, liniment or the like is poured into the bucket 70 to a desired level below the sill, and the apparatus is operated in the manner described with respect to the embodiment of the invention that is shown in FIGS. 1 through 3.

After the treatment is finished, the sheet 73 is removed from its position across the open side portion 70 of the bucket 70 and the horse's legs are lifted over the low sill 72. The used fluid can be poured from the bucket, the bend in the intake conduit 12 (FIG. 1) providing in many cases a suitable handle for tipping the bucket over for this purpose.

Thus, there is provided a therapeutic apparatus for veterinary application that improves significantly over prior techniques through the elimination of a great deal of the waste, human labor and physical danger that attended these older methods.

The spray tubes 35 (FIG. 1) also can be provided with slidable outer sleeves (not shown in the drawing) for selectively blocking the spray apertures to increase the pressure of the flow from the unblocked apertures and also to treat specific portions of the animal's leg e.g. the ankle, the knee, or the hock.

A portion of the fluid moreover can be drawn from the pump 14 at some suitable point on the outlet conduit 16 in order to flow through a heater (not shown in FIG. 1). The warm discharge from the heater is then added to the fluid within the bucket 10 to provide a suitably warm fluid for treating the leg of the injured animal. A typical heater suitable for the purposes of the invention is a Chromalox Model No. 8 120 volt alternating current 2,000 watt heater.

There is need to provide, from time to time, a downwardly directed stream or fluid in order to focus the impact of the fluid on the injured portion of the animal's limb, in contrast to the horizontally directed spray from the apertures of the spray tubes 35 (FIG. 1). In these circumstances, a semicircular manifold is connected to the outlet conduit 16. The manifold is secured to the exterior surface of the bucket 10 immediately below the open top of the bucket by means of Teflon clips or the like. Plastic tubes, or tubes of some similarly easily bent and twistable material, are connected in fluid communication with the manifold at spaced horizontal intervals along its semicircular length. Within these tubes a wire of copper or other suitable material is inserted in order to enable the tubes to retain a desired shape or manually adjustable bend. These tubes, in turn, provide a means for directing a steady stream of fluid at an injured portion of an animal's limb. The wires secured within each of the tubes enable these tubes to maintain their angular and flow orientation relative to the interior of the bucket in spite of the fluid pressure.

The embodiments of the invention in which an exclusive property or privilege is claimed are defined as follows:

1. A veterinary therapeutic apparatus comprising, a top fluid header, nipples protruding downwardly from said top fluid header and in fluid communication therewith, a bottom fluid header, nipples protruding upwardly from said bottom fluid header and in fluid communication therewith, a fluid distribution tube establishing fluid communication between said top fluid header and said bottom fluid header, a plurality of spray tubes, each of said spray tubes pivotally mounted between said top fluid header and said bottom fluid header, said spray tubes each being in fluid communication with a respective one of said downwardly protruding nipples and with one of said upwardly protruding nipples in order to selectively orient said spray tubes in a predetermined direction, a pair of fittings, three of said spray tubes coupled to said fittings, said fittings each being pivotally mounted to a respective one of said downwardly protruding nipples and said upwardly protruding nipples and in fluid communication therewith in order to selectively orient said three spray tubes in a predetermined direction.

2. A veterinary therapeutic apparatus according to claim 1 further comprising a valve in fluid communication with said fluid distribution tube, a gate within said valve, said gate having a hole of predetermined size formed therein in order to prevent said valve from completely interrupting flow therethrough.

3. A veterinary therapeutic apparatus according to claim 2 further comprising a bucket for generally containing said top and bottom headers, said fluid distribution tube and said spray tubes, a screen unit in the side of said bucket and near the bottom thereof for establishing fluid communication with the inside of said bucket, and a pump in fluid communication with said screen unit for promoting fluid flow through said valve in order to produce a therapeutic veterinary spray within said bucket.

4. A veterinary therapeutic apparatus according to claim 1 further comprising a valve in fluid communication with said fluid distribution tube, a gate within said valve, said gate having a hole of predetermined size formed therein order to prevent said valve from completely interrupting flow therethrough.

5. A veterinary therapeutic apparatus according to claim 4 further comprising a bucket for generally containing said top and bottom headers, said fluid distribution tube and said spray tubes, a screen unit in the side of said bucket and near the bottom thereof for establishing fluid communication with the inside of said bucket, and a pump in fluid communication with said screen unit for promoting fluid flow through said valve in order to produce a therapeutic veterinary spray within said bucket.

6. A veterinary therapeutic apparatus comprising, a bottom fluid header, nipples protruding upwardly from said bottom fluid header in fluid communication therewith, a plurality of spray tubes, each of said spray tubes being pivotally mounted on said bottom fluid header, said spray tubes each being in fluid communication with a respective one of said upwardly protruding nipples in order to selectively orient said spray tubes in predetermined directions, a bucket for generally containing said bottom fluid header and said spray tubes, said bucket having a portion of its side removed in order to form a sill spaced from the bottom of said bucket and an opening thereabove in said bucket, and a sheet for selectively closing said bucket opening.

7. A veterinary therapeutic apparatus according to claim 6 wherein said bucket further has a plurality of journal bearings secured to the inner wall thereof each pivotally receiving and supporting a respective one of said spray tubes.

8. A veterinary therapeutic apparatus comprising, a fluid header, nipples protruding from said fluid header and in fluid communication therewith, a plurality of spray tubes, each of said spray tubes being mounted on said fluid header, said spray tubes each being in fluid communication with a respective one of said protruding nipples in order to selectively orient said spray tubes in predetermined directions, a bucket for generally containing said fluid header and said spray tubes, said bucket having a portion of its side removed in order to form a sill spaced from the bottom of said bucket and an opening thereabove in said bucket, and a sheet for selectively closing said bucket opening.

* * * * *